US007735832B2

(12) United States Patent
Bliehall

(10) Patent No.: US 7,735,832 B2
(45) Date of Patent: Jun. 15, 2010

(54) MOVING TARGET SYSTEM FOR TRAINING IN MARKSMANSHIP AND TARGET IDENTIFICATION

(76) Inventor: James Carl Bliehall, 36 Haven Dr., Cedar Crest, NM (US) 87008-9423

( * ) Notice: Subject to any disclaimer, the term of this patent is extended or adjusted under 35 U.S.C. 154(b) by 361 days.

(21) Appl. No.: 11/962,985

(22) Filed: Dec. 21, 2007

(65) Prior Publication Data

US 2008/0150235 A1 Jun. 26, 2008

Related U.S. Application Data

(60) Provisional application No. 60/876,258, filed on Dec. 21, 2006.

(51) Int. Cl.
*F41J 5/14* (2006.01)
*F41J 9/02* (2006.01)

(52) U.S. Cl. ..... 273/393; 273/380; 273/369; 273/406

(58) Field of Classification Search ..... 273/348, 273/359, 366–370, 378–393, 403–410
See application file for complete search history.

(56) References Cited

U.S. PATENT DOCUMENTS 1,293,903 A * 2/1919 Petersen ..... 273/380
2,925,078 A * 2/1960 Ryan, Jr. ..... 124/17
3,054,614 A * 9/1962 Dean ..... 273/446
4,029,318 A 6/1977 Boss
4,553,757 A * 11/1985 Keeney ..... 273/369
4,614,345 A 9/1986 Doughty
4,657,511 A 4/1987 Allard
4,691,925 A 9/1987 Scholem
5,163,689 A 11/1992 Bateman
5,222,741 A * 6/1993 Redl ..... 273/393
5,248,150 A 9/1993 Koma
5,280,919 A 1/1994 Graham
5,310,192 A 5/1994 Miyake
5,320,358 A 6/1994 Jones
5,350,180 A 9/1994 Acock
5,427,380 A 6/1995 Hazard
5,688,196 A 11/1997 O'Neil
5,823,779 A 10/1998 Muehle
5,868,396 A 2/1999 Theissen
5,967,522 A 10/1999 Corcoran
5,980,254 A 11/1999 Muehle (Continued)

*Primary Examiner*—Mark S Graham
(74) *Attorney, Agent, or Firm*—Mayback & Hoffman, P.A.; Gregory L. Mayback; Scott O. Smiley

(57) ABSTRACT

A target moving configuration includes a weighted base, a shooter's target, a target-moving assembly rotationally connected to the base and a hinge pivotally connecting the target thereto. A target-fall control device operatively connects the hinge to selectively pivot the target when activated. The control device has a balloon, a lock with a removable key, and a pull cord connecting the balloon to the key, which cord holds the key in the lock while the balloon is intact. A target motion device has a drive shaft, a drive cord connected to the target moving assembly and the drive shaft. An electric motor is connected to the drive shaft for rotating the drive shaft. A controller is operable to selectively and randomly power the motor to, thereby, move the target movement arm with respect to the base. Multiple targets and assemblies are provided and connected to the drive shaft for independent movement.

12 Claims, 5 Drawing Sheets

U.S. PATENT DOCUMENTS

| | | | | |
|---|---|---|---|---|
| 6,162,057 | A | 12/2000 | Westphal | |
| 6,217,027 | B1 | 4/2001 | Amrein | |
| 6,325,376 | B1 | 12/2001 | Elliott | |
| 6,435,512 | B1 | 8/2002 | Beckwith, Sr. | |
| 6,478,301 | B1 | 11/2002 | Witmeyer | |
| 6,491,303 | B1 | 12/2002 | Huston | |
| 6,502,820 | B2 | 1/2003 | Slifko | |
| 6,575,753 | B2 | 6/2003 | Rosa | |
| 6,604,064 | B1 | 8/2003 | Wolff | |
| 2004/0046321 | A1 * | 3/2004 | Karnofsky | 273/409 |
| 2006/0290063 | A1 * | 12/2006 | Hagar | 273/369 |

* cited by examiner

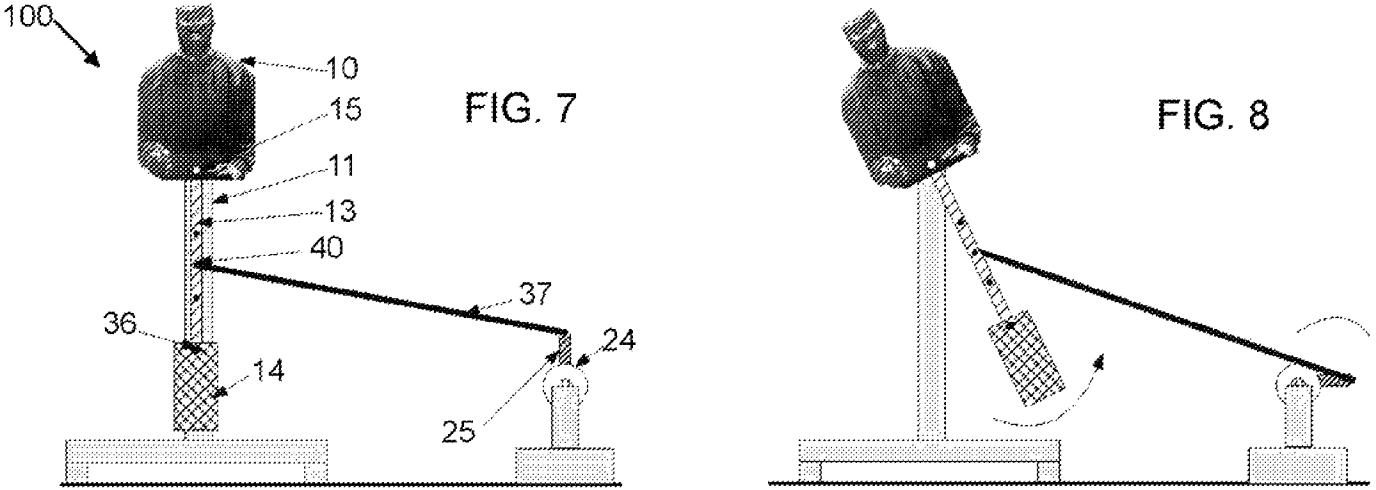
FIG. 7
FIG. 8
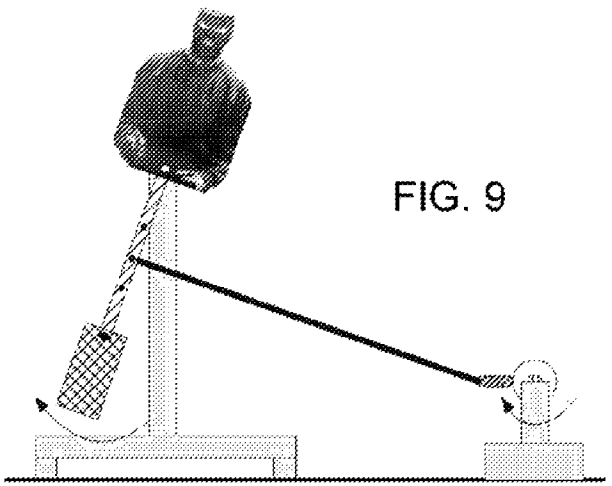
FIG. 9

MOVING TARGET SYSTEM FOR TRAINING IN MARKSMANSHIP AND TARGET IDENTIFICATION

CROSS-REFERENCE TO RELATED APPLICATION

This application claims the benefit under 35 U.S.C. 119(e) of U.S. Provisional Application No. 60/876,258 filed Dec. 21, 2006, the complete disclosure of which is hereby incorporated by reference herein in its entirety.

BACKGROUND OF THE INVENTION

1. Field of the Invention

This invention relates in general to target systems and, specifically, to a marksmanship and target-identification training system using moving targets.

2. Description of Related Art

The target systems being used to train law enforcement and military shooters today are predominantly one of the following enumerated types.

A first prior art target system places the target image in front of the shooter and is stationary and visible at all times. Such a system has the disadvantage of allowing the shooter to constantly see the target image as a threat. The system gives the user no opportunity to recognize the status (threat or no threat) of the target image. Because there is no requirement to recognize the status of the target image, the target is always recognized by the shooter as being a threat. The shooter simply draws their weapon as quickly as possible and shoots the target image as accurately as possible. No real-time, dynamic indication is given to the shooter regarding their accuracy of shot placement other than by examining the target after a series of shots have been fired. Lastly, the target is stationary and does not mimic the motions a real human person would take if they were actually shooting back.

A second prior art target system suspends the target image on a motor driven cable. This system positions the target image at various distances toward and away from the shooter, which allows the system to decrease or increase the difficulty in hitting the target image by altering the relative size of the target. This system has the same disadvantages of the first target system described above.

A third prior art target system keeps the target image stationary but also rotates the image toward or away from the shooter. First, the target image is hidden from view (e.g., at 0 degrees of rotation). Then, the target image is rotated to face the shooter (e.g., 90 degrees). This system has a disadvantage in that the shooter knows before the target image is rotated that when presented it will be a threat target; the shooter knows the target is a threat because the target is inserted in the turning device by the shooter and the image of the target is known to be a threat. As is known, a range officer would not mount a no-threat target and have it rotate into the shooter's view only to see if the shooter would engage it. It would be a waste of time. This system has the same disadvantages of the first target system described above.

A fourth prior art target system physically moves the target into and out of the shooter's field of view. As an example, a pneumatic system with rubber targets can be brought into view by rapidly filling them with air. This system has a disadvantage because it is limited to making stationary targets appear and disappear from view at the same location. This system also has the disadvantages of the first target system described above.

A fifth prior art target system rotates the target image rotate left and right around a centerline parallel with the ground (like a pendulum). The target rotates around a center point with the target at the top and a fixed counter weight at the bottom. In this system, the target is attached to a counterweight having the same weight as the target (the target is above the axle and the counterweight is below the axle). An instructor pulls the rope and the target rotates back and forth in the vertical plane always in view of the shooter and moving like the pendulum of a clock. This kind of target presentation is a challenge to the shooter because the target moves in an arc. The disadvantage of this system lies in the fact that the movement of the target is controlled by a cord that is attached to the counterweight. The cord is pulled and released by a person to cause the movement. If several shooters are being trained on one mechanical system with several targets connected in tandem, the amplitude and duration of movement of the individual target movements will mimic each other and be rhythmic, much like pendulums on several clocks or musical metronomes swinging in unison. This system also experiences the disadvantages described with respect to the first system above.

It would be desirable to provide a system that overcomes the disadvantages of the aforementioned systems.

SUMMARY OF THE INVENTION

The inventive target systems of the present invention provides a moving target system for marksmanship and target identification training that overcomes the hereinafore-mentioned disadvantages of the heretofore-known devices and methods of this general type and that improves the quality of shooter training, makes such training more consistent by giving the target movements that mimic that of a human being—the movements are more random, non-synchronous, and/or non-repetitive. The movements of the inventive system are produced with a motor drive that can accept any type of target, such as a bull's eye, a circle, and other defined objects. The targets most often used in training law enforcement and military shooters depict a person. Thus, the system of the present invention can provide targets in the image of a person, whether presenting a weapon (a threat) or not presenting a weapon (no-threat or hostage).

With the foregoing and other objects in view, there is provided, in accordance with the invention, a target moving configuration, includes a weighted base having a vertical extension, the base having a weight sufficient to prevent toppling of the base when hit by a high-velocity projectile, a shooter's target, a target-moving assembly having a target movement arm rotationally connected to the base, a target connection arm fixedly connected to the target, and a hinge pivotally connecting the target connection arm to the target movement arm, a target-fall control device operatively connected to the hinge to selectively pivot the hinge and lower the target when activated, the target-fall control device having a frangible balloon of a material to be broken by a high-velocity projectile, a lock connected to the target connection arm and to the target movement arm, the lock having a removable key, and a pull cord connecting the balloon to the key, the pull cord holding the key in the lock while the balloon remains intact and releasing the key from the lock when the balloon is broken, With the objects of the invention in view, there is also provided a multiple target moving system, comprising a set of target assemblies, each having a weighted base having a vertical extension, the base having a weight sufficient to prevent toppling of the base when hit by a high-velocity projectile, a shooter's target, a target-moving assembly having a target movement arm rotationally connected to the base, a target connection arm fixedly connected to the target, a hinge pivotally connecting the target connection arm to the target movement arm, a target-fall control device operatively connected to the hinge to selectively pivot the hinge and lower the target when activated, the target-fall control device having a frangible balloon of a material to be broken by a high-velocity projectile, a lock connected to the target connection arm and to the target movement arm, the lock having a removable key, and a pull cord connecting the balloon to the key, the pull cord holding the key in the lock while the balloon remains intact and releasing the key from the lock when the balloon is broken, a target motion device having a drive shaft having a rotation axis and a crank for each of the target assemblies, adjacent crank being offset from one another about the rotation axis, a drive cord for each of the target assemblies, each drive cord connected to a respective portion of the target movement arm and to the crank, an electric motor connected to the drive shaft and rotating the drive shaft when powered, and a controller electrically connected to the motor and operable to selectively and randomly power the motor to, thereby, move the target movement arms with respect to the bases thereof dependent upon the powering of the motor by the controller.

In accordance with another feature of the invention, a target motion device has a drive shaft with at least one crank, a drive cord connected to a portion of the target movement arm and to the crank, an electric motor connected to the drive shaft and rotating the drive shaft when powered, and a controller electrically connected to the motor and operable to selectively and randomly power the motor to, thereby, move the target movement arm with respect to the base dependent upon the powering of the motor by the controller.

In accordance with another feature of the invention, the target has a shape corresponding to at least an upper portion of a human and at least one of a direction of movement, a type of movement, a magnitude of movement and a speed of movement of the target movement arm by the controller causes the target to mimic movement of a human being.

In accordance with a further feature of the invention, the target-moving assembly and the target-fall control device force the target to fall over and out of a shooter's field of view when the target is shot to break the balloon.

In accordance with an added feature of the invention, the target has a threat-status-changing device. The threat-status-changing device has an obscuring medium removably connected to a face of the target and a removal device selectively removing the obscuring medium from the target.

In accordance with an additional feature of the invention, there is also provided a remote control operatively connected to at least one of the controller and the motor.

In accordance with yet another feature of the invention, the target has a portion defining a shooter's line of fire and the pull cord is attached to the balloon to substantially place the pull cord outside of the portion.

In accordance with yet a further feature of the invention, the drive cord is a flexible wire, a flexible cord, and/or a substantially rigid shaft.

In accordance with yet an added feature of the invention, the target movement arm is weighted adjacent a bottom thereof.

In accordance with a concomitant feature of the invention, the target movement arm has a weight adjacent a bottom thereof greater than a weight of the target.

The target system has a motor driven crankshaft with two or more cranks on a shaft or set of shafts. The shaft is connected directly to a drive motor and one selectable crank is disconnected from the crankshaft but has the ability to be remotely connected to the crankshaft on remote command by the system operator. The selectable crank is engaged to the moving crankshaft, for example, with a mechanical solenoid and an engagement mechanism.

The crankshaft cranks are connected through a cord to targets having an adjustable counterweight, for example, at a bottom thereof. The target swings back and forth on a center axle but its movements are controlled by various measures. One control is effected with the speed of the motor driving the crankshaft; higher revolutions per minute translate into faster target arc movement rates. Another control is a position of the counterweight relative to the swing arm on which the target arm is mounted. If the counterweight is positioned directly in line with the target swing arm, the target movements will be more smooth and even. However, if the counterweight is positioned at progressively greater angles with respect to the swing arm, the target movements become more erratic and non-synchronous. Another factor influencing control is the duration of motor on time. If the motor drive is on continuously, the target movements will be more smooth and rhythmic. However, if the motor drive is turned on and off, whether periodically or randomly, the target will display erratic or chaotic movements. A further factor influencing target control is the length of a cord connecting the target swing arm to the crankshaft crank. If the cord between the motor and the crankshaft crank to which it is attached is shorter, the target will swing in a larger arc, following the movement of the crankshaft crank to which it is attached.

Further, the target can be configured to fall out of the shooter's field of view (FOV) when the shooter accurately hits the target image or a desired area on the target image. To mimic this falling movement, the target is mounted on a rotational target arm that is held in a locked position by a removable locking pin. The locking pin is held up by a balloon that is positioned and held rigid behind the head section of the target image. When the shooter hits the area of the target image corresponding to the head, for example, the balloon breaks, releasing the locking pin, which falls to the ground. Consequently, the target arm on which the target image is mounted rotates approximately 90 degrees causing the target image previously parallel to the shooter to move out of the shooter's field of view or to just indicate that the target is no longer a valid target. Because inaccurately placed shots will not burst the balloon, such hits will not cause the target to fall, i.e., the target image remains upright.

The image of the person on a printed target can have a hand visible to the shooter. This hand can contain a weapon, defining the target a "threat" target. The system of the present invention allows the system operator to remotely and instantly change the target threat status from a "threat" to a "no-threat" or from a "no-threat" to a "threat." The target system has a selectable crank, which the operator can engage using a remote control. In use, the image of the weapon in the target's hand is covered by an obscuring medium (such as a piece of cardboard with a section of newspaper glued to it to depict a person holding a newspaper). A mechanical connector holds the obscuring medium in place over the target image's band (holding the weapon). The mechanical connector can be a large staple, Velcro, double-sided tape, a paper clip, a piece of wood with nails in it, or any other fastener that can be quickly removed with little force. The obscuring medium itself or the device being used to hold the obscuring medium to the target image is connected through a cord to the selectable crank on the crankshaft. When the operator energizes, for example, the push solenoid actuator using a remote control, the selectable crank is connected to the moving crankshaft with an engagement or locking mechanism. The continuously turning crankshaft now can turn the selectable crank and pull the obscuring medium off the front of the target or pull the contrivance holding the obscuring medium on the target face free from the target. The obscuring medium falls to the ground (or elsewhere) and the target reverts from a "no-threat" to a "threat" with the weapon now visible.

The system also allows the operator to change the "threat" target to a "no-threat" target. For example, an image of a hand or other non-lethal object is connected firmly over the weapon image on the target and an obscuring medium containing the image of a weapon (or weapon in a hand) is placed over the hand. Thus, while the weapon is visible, the shooter must engage the threat target. However, as soon as the target changes to a no-threat target—when the obscuring medium is removed and simulating the target having dropped their weapon—the shooter must cease fire. This is excellent training for the shooter because it prevents a shooting of a no-threat target.

The invention has a number of distinct advantages over prior art target systems. First, the system is able to mimic human movements, increasing the level of shooter training. Next, these unique movements are adjusted easily by the system operator and permit a variation of different skill levels. Simple, slow movements can be used for new shooters and more difficult, random and erratic movements can be used for advanced shooters. Further, the system can quickly change the status of the target from threat to no-threat or vice-versa, changes that occur in real life situations. This changeability requires the shooter to constantly be aware of the target's status, improving the skill set of the shooter. Additionally, the system is configured to require the shooter to accurately engage single or multiple moving targets. With an ability to present two targets at one time, one in front of the other, the shooter is given the opportunity to practice engaging a "threat" target while avoiding the no-threat target. The targets can be arranged with the no-threat target in front and the threat target behind or vice-versa. The system can even make both targets threat targets, requiring the shooter to engage both.

Significantly, the system responds with positive and real-life feedback. For example, after accurately shooting a target, the target responds by falling out of the shooter's field of view. By falling when correctly hit by the shooter, the system gives an immediate response regarding the accuracy of bullet placement by the shooter. If a shooter observes no reaction in the first shot or shots taken, they know that they must keep on shooting because the target has not fallen. This is in contrast to prior art systems that require the shooter to approach the fixed target and personally view the holes or to do so through a telescope.

The system can be adjusted to present repeatable target movements to multiple shooters, thereby making it easier and more equitable when evaluating multiple shooters' capabilities. The system also can be operator adjusted to move the targets at controlled speeds and in predetermined and repeatable directions. Such features allow an instructor to work out a bad habit of a student shooter, for example.

Other features that are considered as characteristic for the invention are set forth in the appended claims.

Although the invention is illustrated and described herein as embodied in a moving target system for marksmanship and target identification training, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

The accompanying figures, where like reference numerals refer to identical or functionally similar elements throughout the separate views, and which together with the detailed description below are incorporated in and form part of the specification, serve to further illustrate various embodiments and to explain various principles and advantages all in accordance with the present invention.

FIG. 7 is a front elevational view of a further exemplary embodiment of a target assembly according to the invention with the target in an intermediate position;

FIG. 8 is a front elevational view of the target assembly of FIG. 6 with the target pivoted away from the motor assembly;

FIG. 9 is a front elevational view of the target assembly of FIG. 6 with the target pivoted towards the motor assembly;

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

Figure 2:
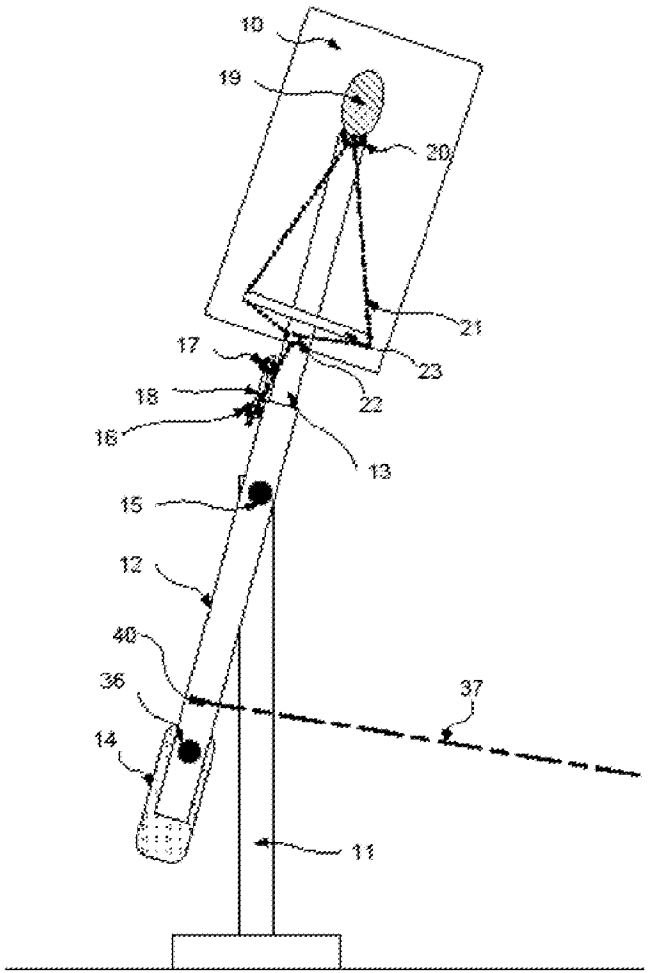
FIG. 2 is a rear elevational view of the target assembly of FIG. 1 with a balloon positioned behind a target and connected to a retaining pin holding the target upright.
Figure 1:
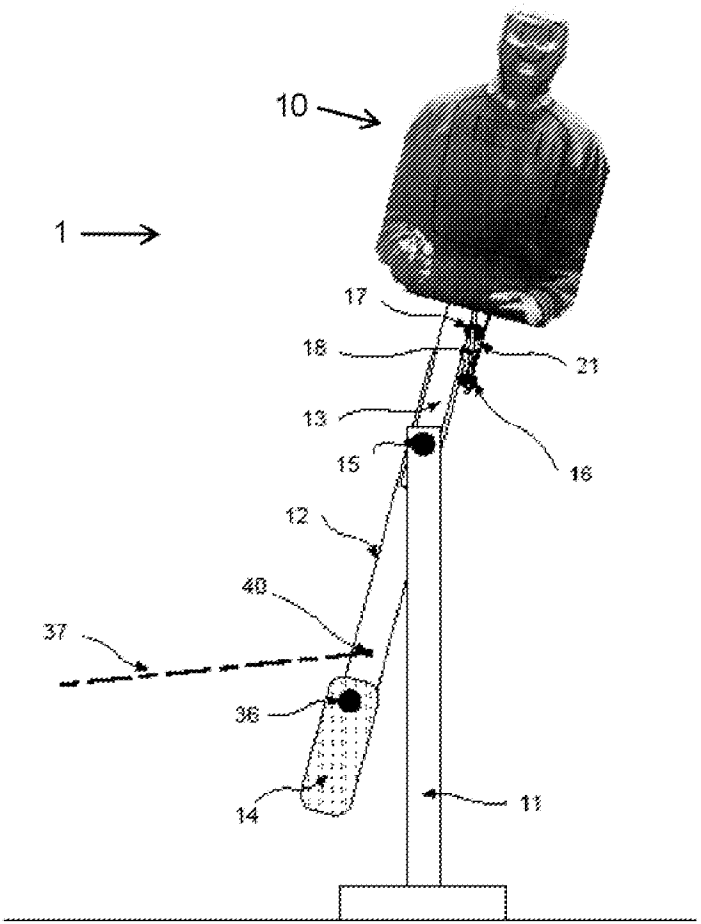
FIG. 1 is a front elevational view of an exemplary embodiment of a target assembly according to the invention.
Figure 3:
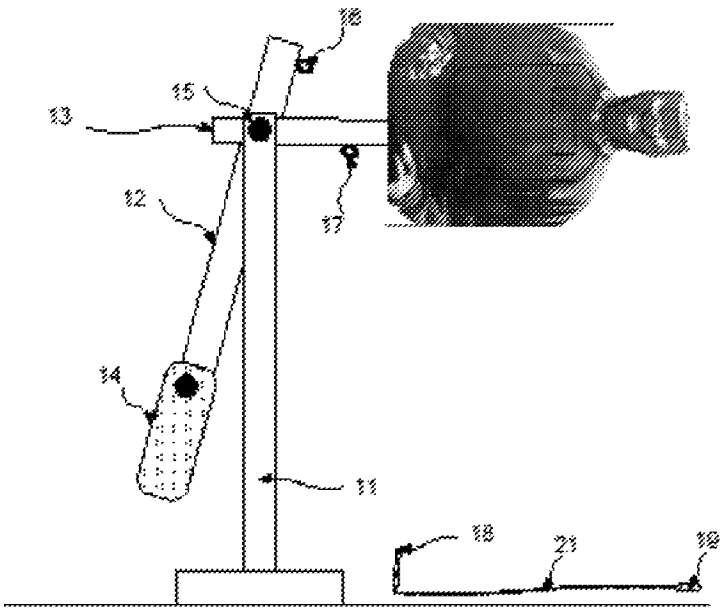
FIG. 3 is a front elevational view of the target assembly of FIG. 1 in a downed position.

Embodiments herein can be implemented in a wide variety of ways using a variety of technologies that enable random movement of targets. One embodiment of the present invention utilizes a target system 1 that mimics human movement. Turning now to FIGS. 1 to 3, there is shown a shooter's target 10 directly mounted to a target arm 13. The target arm 13 is movably mounted to a vertical support 11 through a pivot 15, which can be in the form of an axle. The pivot 15 allows the target 10 to move freely in an arc about the rotation axis of the axle 15. Because the target 10 is intended for use with projectiles (i.e., projectiles having significant velocities), the support 11 is envisioned to remain upright if the target 10 is hit and even if any other portion of the system, e.g., the support 11, is hit. Where the projectiles are bullets (i.e., projectiles having velocities of greater than about 800 feet per second (fps)), the support 11 is envisioned to remain upright if the target 10 is hit and even if any other portion of the system, e.g., the support 11, is hit by the bullet. Thus, the base of the support 11 is weighted sufficiently to keep the system 1 upright. As used herein, such gun-fired projectiles are referred to as high-velocity projectiles.

It is desirable for the target 10 to move from a raised position (shown in FIGS. 1 and 2) to a lowered position (see FIG. 3) after being hit by a projectile in a desired target location, e.g., the head of the person depicted on the target 10. Thus, the target 10 is provided with a selective fastening device to place the target 10 in these two positions. Further, when the target 10 is hit by a high-velocity projectile (imparting a significant amount of energy to the target 10), the selective fastening device needs to be reliable and cause the target 10 to pivot when struck in the desired hit area; it should be difficult to destroy the pivoting mechanism with the projectile. To reliably accomplish this selective fastening, a balloon device 19 is used. This balloon 19 can be made of any material strong enough to remain intact when pressure is being exerted upon it to keep the balloon 19 in position but weak enough to break when hit by a projectile. Example materials for the balloon 19 include nitrile, polyethylene, polypropylene, latex, natural rubber, to name a few. When high-velocity projectiles are used, the balloon 19 can be thicker or of a relatively stronger material.

When the balloon 19 is secured to the rear of the target 10, the selective fastening device is placed in a locked state to keep the target 10 upright. When the balloon 19 is destroyed, the force keeping the fastening device locked is removed, allowing the target 10 to pivot to the lowered position. It is noted that if the target 10 is made out of paper, then there is little chance of target fragmentation to burst/break the balloon 19. However, if the target 10 is made from other materials, for example, the balloon 19 can be made sufficiently strong enough to withstand shrapnel from the target 10 but not strong enough to withstand a direct hit from the projectile.

In one exemplary embodiment, the target 10 is held in the upright position with a selective target arm fastening assembly, which can, for example, be comprised of a target arm eyebolt 17, a swing arm eyebolt 16, and a retaining pin 18 working in conjunction with one another. Because the target arm 13 rotates about the axle 15, in the same way that a swing arm 12 rotates about the axle 15, all that is needed to keep the target 10 in the upright position is to removably fasten these two arms to one another. Because the target system 1 is being used on a dangerous shooting range, it is desirable to have an easy to use and simple assembly to keep the arms 12, 13 together until the balloon 19 is broken. In the present embodiment, the retaining pin 18 is suspended within the eyes of the two eyebolts 16, 17. The cord 21, extending from the bottom of the balloon 19 around a tensioning target arm 23, and to a balloon cord loop 22, hangs the retaining pin 18 in the two eyes of the eyebolts 16, 17. Thus, the retaining pin 18 is kept in position to lock the two arms 12, 13 relative to one another. A retaining wire ring 20 is mounted to the target arm 13 and holds the balloon 19 at the target arm 13 with the weight of the cord and retaining pin 18. The balloon cord 21 is positioned around one or more spread arms 23, which physically move the balloon cord 21 from the center of the target 10 towards the edges thereof, making the balloon cord 21 less likely to be shot during a training exercise, a condition that would cause the target 10 to fall over prematurely. FIG. 2 illustrates the balloon cord in the shape of a triangle. Alternatively, with two spread arms 23, for example, an upper portion of the cord 21 can be extended away from the "head" of the target 10 and, thereafter, travel down the sides thereof in the shape of a rectangle. Additionally the balloon cord 21 has a balloon cord loop 22 that keeps the target 10 upright if one or the other sides of the balloon cord 21 are inadvertently shot.

When the shooter accurately shoots the target 10, the balloon 19 breaks and the tension on the retaining pin 18 is released. This release of tension allows the retaining pin 18 to fall from inside the target arm eyebolt 17 and the swing arm eyebolt 16. Consequently, the target 10, attached to the target arm 13, falls over out of the shooters' field of view, as shown in FIG. 3. If this target system 1 is placed behind a set, such as a mock-up of a window in a wall of a house (not illustrated), the target 10 will be visible in the window when upright and will be out of the shooter's FOV when lowered.

If the operator wants the target 10 to stay in the upright position for repeated training without use of the balloon 19, the balloon cord 21 can be wrapped or tied around both the eyebolts 16, 17.

Side-to-side movement of the target 10 is accomplished by alternately pulling and releasing a front-target drive cord 37 attached to the swing aim 12 by a target drive cord connector 40, which can be in the form of a length-adjusting bolt. The alternating pull/release can be carried out, for example, by a motorized movement system 2 illustrated in FIG. 4. The front-target drive cord 37 is attached to a front target crank 25, which is driven by a crankshaft drive motor 24.

The speed and duration of crankshaft drive motor rotation is controlled by a controller 31, which can be remotely controlled for safety. The controller 31 selectively supplies power to the motor 24 through an electric mains 30, for example, an outlet or a battery. The controller 31 controls the crankshaft drive motor 24 to turn on and off at random times, which movement causes the front-target drive cord 37 to pull and release the swing arm 12 with corresponding random movement. The magnitude of motion of the target 10 is controlled by adjusting the length of the front-target drive cord 37, which is held captive by the target drive cord connector 40.

The side-to-side motion of the target 10 is also controlled by a vertical position of a counterweight 14 relative to the swing arm 12. The counterweight 14 position is adjustable, through a height adjustment device 36. This device 36 can be loosened to reposition vertically the counterweight 14 and then re-tightened to fix the vertical positioning. As the counterweight 14 is moved, the swing arm 12 will return to an upright position either slower (lowered) or faster (raised). This action, combined with the random on/off times of the crankshaft drive motor 24, cause the target 10 to move unpredictably.

As set forth above, the system is configured to allow the shooter to engage multiple moving targets. In this vein, the target assembly 1 is referred to sometimes as a front target assembly because a number of other, separate target assemblies 1 can be placed one behind the other either in a row, possibly for subsequent shooting, or staggered. A rear target assembly is not shown because it would be redundant and it can be an exact duplicate of the front target assembly 1.

However, this rear target assembly is envisioned to be driven by a rear-target drive cord 38. See FIG. 4. By being attached on the rear target crank 26, the rear target assembly will move side-to-side out of synchronization (180 degrees) with the front target 10. This 180 degree opposition is merely exemplary and can be changed to any different angle, i.e., ±180 degrees.

Figure 4:
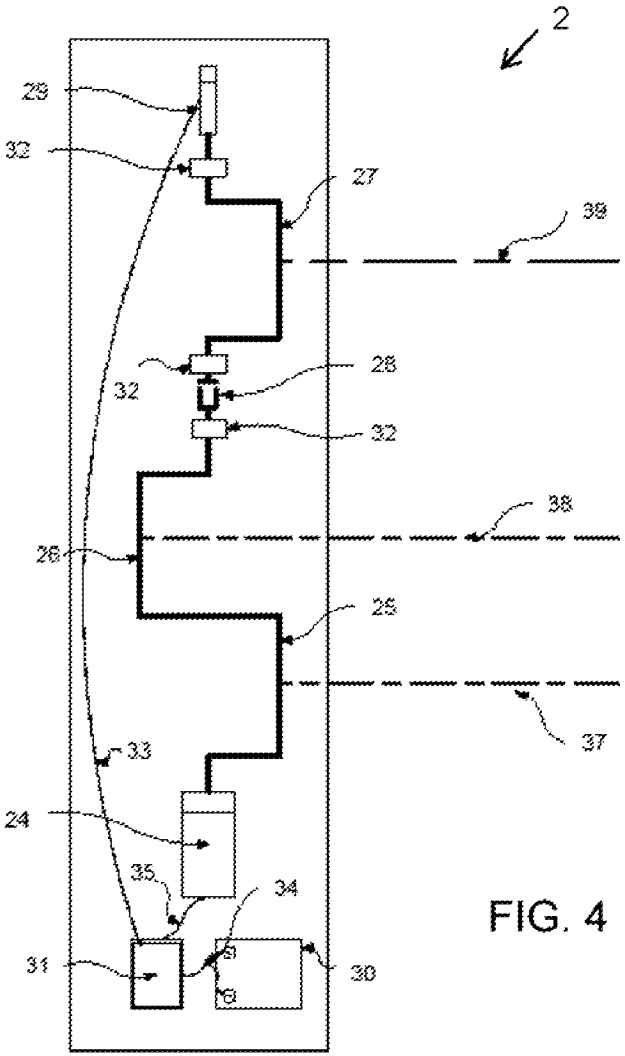
FIG. 4 is a diagrammatic plan view of a motor drive assembly for the target assembly of FIG. 1 with two constantly driven cranks and one selectable crank to change a threat status of a target.
Figure 6:
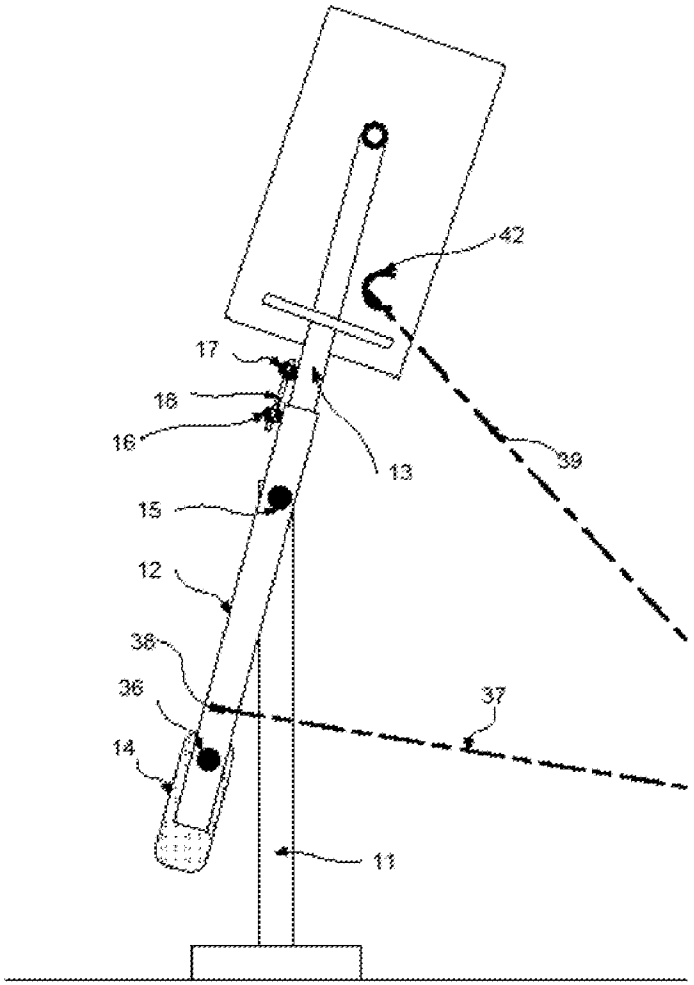
FIG. 6 is a rear elevational view of the target assembly of FIG. 5 pivoted towards the control assembly.
Figure 5:
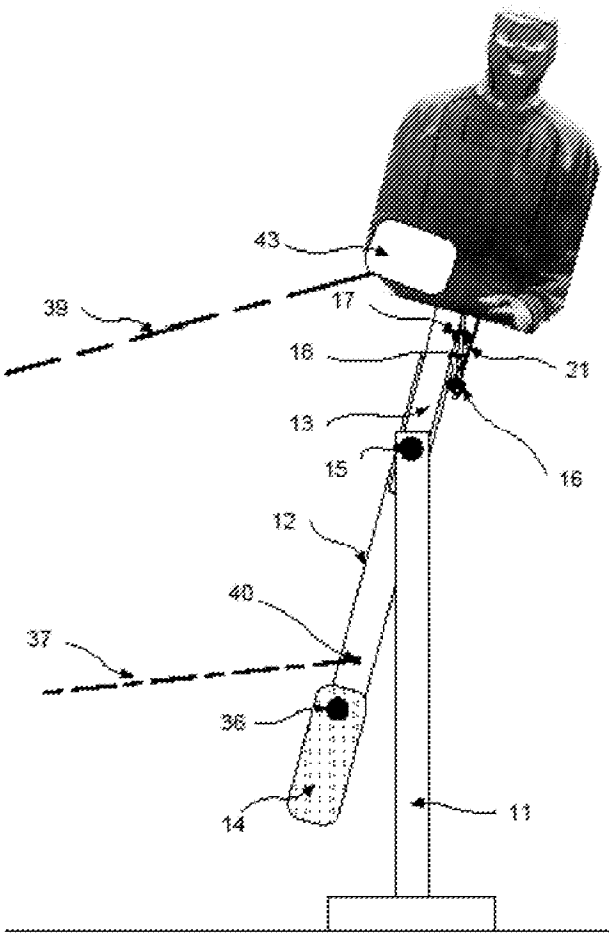
FIG. 5 is a front elevational view of another exemplary embodiment of a target assembly according to the invention with an obscuring medium in front of an image of a weapon on a target and with the target pivoted away from a control assembly.

Additionally, or alternatively, the target assembly 1 can be provided with measures for changing a target status from "hostile" to "non-hostile", which is also referred to herein as "threat" or "no-threat." Referring to FIGS. 4 to 6, an obscuring device 43 is positioned on the target 10 and held in place by a suitable removable fastener 42, such as a staple, tape, or VELCRO®. A threat transition drive cord 39 is attached to the fastener 42 and connected to a selectable crank 27 which is stationary at this point in the explanation and as shown in FIG. 4. When the system operator energizes a non-illustrated remote control, a selectable crank activation device 33 causes a selectable crank actuator 29 (e.g., a solenoid) to move the selectable crank 27 into engagement with the front and/or rear target cranks 25, 26, which are being driven by the crankshaft drive motor 24. In one exemplary embodiment, a selectable crank engaging mechanism 28 is a set of toothed gears that come into contact with one another when the selectable crank 27 is moved towards the rear target crank 26. The selectable crank engaging mechanism 28 can also be a simple "T" and "U" attachment configuration, where the "T" attachment enters the "U" attachment to interlock the selectable crank 27 and the rear crank 26. Thus, the selectable crank 27 will turn at the rate of the rear crank 26, which turns at the rate of the crankshaft drive motor 24 (unless speed reducing/increasing gears are interposed therebetween). When the selectable crank 27 turns, the threat transition drive cord 39 is tightened to such an extent that the obscuring device 43 is pulled from the target 10. The obscuring device 43 can, if desired, just fall to the ground near the target assembly 1.

Bearings 32, such as pillow blocks, support the rear target crank 26 and selectable crank 27 to keep the rotational axes thereof in alignment with one another.

FIGS. 7 to 9 illustrate another exemplary embodiment of a target assembly 100 according to the invention. In this exemplary assembly 100, the target merely rocks right and left (FIGS. 8 and 9, respectively).

Figures 10, 11, 12:
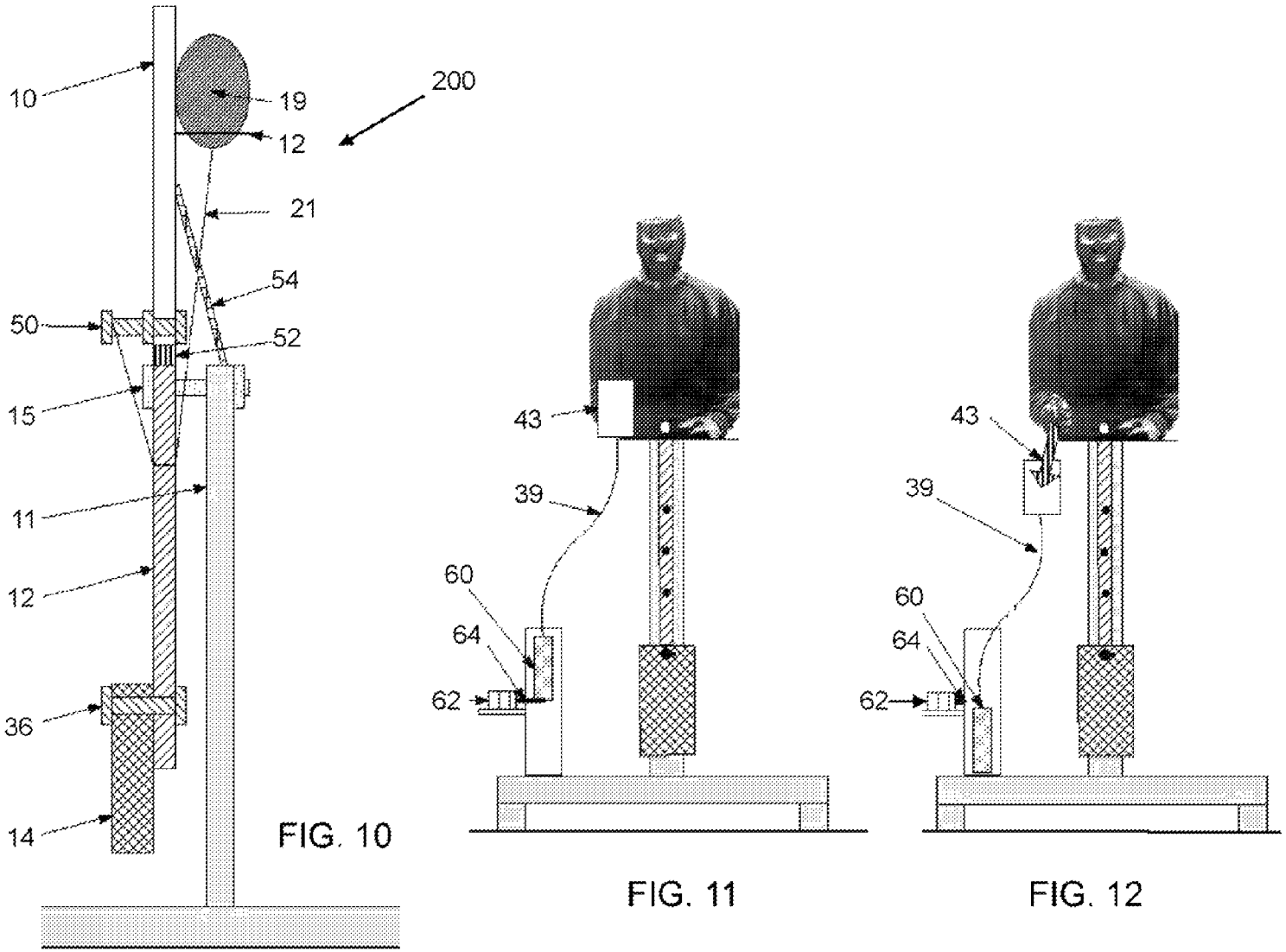
FIG. 10 is a cross-sectional view of yet another exemplary embodiment of a target assembly according to the invention.
FIG. 11 is a front elevational view of the target assembly of FIG. 10 with an obscuring medium in front of an image of a weapon on a target.
FIG. 12 is a front elevational view of the target assembly of FIG. 10 with the obscuring medium falling away from the image of the weapon on the target.

FIGS. 10 to 12 illustrate yet a further exemplary embodiment of a target assembly 200 according to the invention. In this assembly 200, when the target 10 is hit at a location in which the balloon 19 breaks, the balloon cord 21 is allowed to fall. This cord 21 is attached to a front flange of a target pivot assembly 50. The target 10 is pivotally attached to the swing arm 12, not in the plane of the target 10 but orthogonal thereto. In other words, a hinge 52 allows the target 10 to fall backwards (to the right of FIG. 10) when the downward force exerted upon the forward flange by the cord 21 remains. When this force is removed, a rearward-biasing target spring cord 54 forces the target 10 to pivot rearward, in other words, to fall back with respect to the shooter and out of the shooter's POV.

This embodiment also includes an alternative assembly for removing the obscuring device 43. In this assembly, the obscuring device 43 is attached to a threat transition drive cord 39 and the cord 39 is attached (at its opposite end) to an actuator free weight 60. When the transition actuator assembly 62 is in an unactuated state, the weight 60 remains stationary. However, when the transition actuator assembly 62 is actuated, the weight 60 is allowed to fall and, thereby, remove the obscuring device 43 from the target 10. If the transition actuator assembly 62 takes the form of a solenoid, a weight platform 64 can be attached to the solenoid axle 64 to carry the weight 60 while the solenoid is unactuated. When desired, the solenoid is actuated and the platform 64 is pulled out from below the weight 60 to allow the weight 60 to fall.

Non-Limiting Examples

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

What is claimed is:

1. A target moving configuration, comprising:

a weighted base having a vertical extension, said base having a weight sufficient to prevent toppling of said base when hit by a high-velocity projectile;

a target;

a target-moving assembly having:

a target movement arm rotationally connected to said base;

a target connection arm fixedly connected to said target; and a hinge pivotally connecting said target connection arm to said target movement arm;

a target-fall control device operatively connected to said hinge to selectively pivot said hinge and lower said target when activated, said target-fall control device having:

a frangible balloon of a material to be broken by a high-velocity projectile;

a lock connected to said target connection arm and to said target movement arm, said lock having a removable key; and a pull cord connecting said balloon to said key, said pull cord holding said key in said lock while said balloon remains intact and releasing said key from said lock when said balloon is broken.

2. The configuration according to claim 1, further comprising a target motion device having:

a drive shaft having at least one crank;

a drive cord connected to a portion of said target movement arm and to said at least one crank;

an electric motor connected to said drive shaft and rotating said drive shaft when powered; and a controller electrically connected to said motor and operable to selectively and randomly power said motor to, thereby, move said target movement arm with respect to said base dependent upon the powering of said motor by said controller.

3. The configuration according to claim 2, wherein:

said target has a shape corresponding to at least an upper portion of a human; and at least one of a direction of movement, a type of movement, a magnitude of movement and a speed of movement of said target movement arm by said controller causes said target to mimic movement of a human being.

4. The configuration according to claim 1, wherein said target-moving assembly and said target-fall control device force said target to fall over and out of a shooter's field of view when said target is shot to break said balloon.

5. The configuration according to claim 1, wherein said target has a threat-status-changing device.

6. The configuration according to claim 4, wherein said threat-status-changing device has:

an obscuring medium removably connected to a face of said target; and a removal device selectively removing said obscuring medium from said target.

7. The configuration according to claim 2, further comprising a remote control operatively connected to at least one of said controller and said motor.

8. The configuration according to claim 1, wherein:

said target has a portion defining a shooter's line of fire; and said pull cord is attached to said balloon to substantially place said pull cord outside of said portion.

9. The configuration according to claim 2, wherein said drive cord is one of a flexible wire, a flexible cord, and a substantially rigid shaft.

10. The configuration according to claim 1, wherein said target movement arm is weighted adjacent a bottom thereof.

11. The configuration according to claim 1, wherein said target movement arm has a weight adjacent a bottom thereof greater than a weight of said target.

12. A multiple target moving system, comprising:

a set of target assemblies, each having:

a weighted base having a vertical extension, said base having a weight sufficient to prevent toppling of said base when hit by a high-velocity projectile;

a target;

a target-moving assembly having:

a target movement arm rotationally connected to said base;

a target connection arm fixedly connected to said target;

a hinge pivotally connecting said target connection arm to said target movement arm;

a target-fall control device operatively connected to said hinge to selectively pivot said hinge and lower said target when activated, said target-fall control device having:

a frangible balloon of a material to be broken by a high-velocity projectile;

a lock connected to said target connection arm and to said target movement arm, said lock having a removable key; and a pull cord connecting said balloon to said key, said pull cord holding said key in said lock while said balloon remains intact and releasing said key from said lock when said balloon is broken;

a target motion device having:

a drive shaft having a rotation axis and a crank for each of said target assemblies, adjacent cranks being offset from one another about said rotation axis;

a drive cord for each of said target assemblies, each said drive cord connected to a respective portion of said target movement arm and to said crank;

an electric motor connected to said drive shaft and rotating said drive shaft when powered; and a controller electrically connected to said motor and operable to selectively and randomly power said motor to, thereby, move said target movement arms with respect to said bases thereof dependent upon the powering of said motor by said controller.

* * * * *